US007845061B2

(12) United States Patent
Buytaert et al.

(10) Patent No.: US 7,845,061 B2
(45) Date of Patent: Dec. 7, 2010

(54) LOW CLEARANCE CENTRALIZER AND METHOD OF MAKING CENTRALIZER

(75) Inventors: Jean Buytaert, Mineral Wells, TX (US); Eugene Edward Miller, Weatherford, TX (US); Jimmy Mack Young, Weatherford, TX (US)

(73) Assignee: Frank's International, Inc., Houston, TX (US)

( * ) Notice: Subject to any disclaimer, the term of this patent is extended or adjusted under 35 U.S.C. 154(b) by 288 days.

(21) Appl. No.: 11/749,544

(22) Filed: May 16, 2007

(65) Prior Publication Data

US 2008/0283237 A1 Nov. 20, 2008

(51) Int. Cl.
*B23P 13/04* (2006.01)
*B21D 28/00* (2006.01)
*E21B 17/10* (2006.01)

(52) U.S. Cl. ..... 29/557; 29/896.9; 29/446; 72/341; 166/241.6

(58) Field of Classification Search ..... 29/896.9, 29/446, 557; 72/341–348; 166/241.1, 241.4, 166/241.5, 241.6, 242.1
See application file for complete search history.

(56) References Cited

U.S. PATENT DOCUMENTS

| | | | | |
|---|---|---|---|---|
| 2,009,496 | A * | 7/1935 | Johnson | 76/104.1 |
| 2,312,600 | A | 3/1943 | Steps | |
| 2,718,266 | A | 9/1955 | Berry et al. | |
| 3,124,196 | A | 3/1964 | Solum | |
| 3,200,884 | A * | 8/1965 | Solum et al. | 166/241.6 |

(Continued)

FOREIGN PATENT DOCUMENTS

| | | |
|---|---|---|
| GB | 2148985 | 6/1985 |

(Continued)

OTHER PUBLICATIONS

PCT/US2008/063163 International Search Report and Written Opinion, dated Nov. 28, 2008, 19 pages.

(Continued)

*Primary Examiner*—David P Bryant
*Assistant Examiner*—Sarang Afzali
(74) *Attorney, Agent, or Firm*—Patrick K. Steele; Streets & Steele

(57) ABSTRACT

A bow-spring centralizer includes a center assembly having a plurality of bow springs and a pair of generally tubular moving collars secured one to each end of each bow spring, the center assembly formed intermediate a pair of generally tubular stop collars. Each moving collar/stop collar combination forms an interlocking and axially extendable collar. The centralizer is formed from a single tube. The tube is cut using a laser according to a cut pattern that creates interlocked stop collar/moving collar combinations that are rotatably locked but axially movable one relative to the other. Each of the interlocked stop collars and moving collars includes a plurality of circumferentially spaced heads, each head integrally formed on one of a plurality of circumferentially spaced extensions protruding from the stop collar or moving collar. The heads may have a variety of projected shapes, such as a rectangular, arrow or a teardrop shaped. Each head is axially slidably captured within one of a plurality of chambers on the other tubular member (stop collar or moving collar) to which the first member is coupled. The extensions of each interlocked tubular member define the outer walls of the chamber in which a head of the opposing tubular member is slidably captured.

11 Claims, 8 Drawing Sheets

U.S. PATENT DOCUMENTS

| | | | | |
|---|---|---|---|---|
| 3,356,147 | A | 12/1967 | Dreyfuss | |
| 3,566,965 | A | 3/1971 | Solum | |
| 4,269,269 | A | 5/1981 | Wilson | |
| 4,328,839 | A | 5/1982 | Lyons et al. | |
| 4,545,436 | A | 10/1985 | Harrison | |
| 4,651,823 | A | 3/1987 | Spikes | |
| 4,688,636 | A | 8/1987 | Hennessey | |
| 4,787,458 | A | 11/1988 | Langer | |
| 5,238,062 | A | 8/1993 | Reinholdt | |
| 5,261,488 | A | 11/1993 | Gullet et al. | |
| 5,575,333 | A | 11/1996 | Lirette et al. | |
| 5,908,072 | A | 6/1999 | Hawkins | |
| 6,209,638 | B1 * | 4/2001 | Mikolajczyk | 166/241.1 |
| 6,457,519 | B1 | 10/2002 | Buytaert et al. | |
| 6,484,803 | B1 | 11/2002 | Gremillion | |
| 6,679,325 | B2 | 1/2004 | Buytaert | |
| 6,725,939 | B2 | 4/2004 | Richard | |
| 6,871,706 | B2 | 3/2005 | Hennessey | |
| 7,096,939 | B2 | 8/2006 | Kirk et al. | |
| 7,143,848 | B2 | 12/2006 | Armell | |
| 7,188,687 | B2 * | 3/2007 | Rudd et al. | 175/171 |
| 2002/0139537 | A1 | 10/2002 | Young et al. | |
| 2002/0139538 | A1 | 10/2002 | Young et al. | |
| 2003/0000607 | A1 | 1/2003 | Jenner | |
| 2008/0035331 | A1 * | 2/2008 | Buytaert | 166/241.6 |
| 2008/0115972 | A1 | 5/2008 | Lynde et al. | |

FOREIGN PATENT DOCUMENTS

| | | | |
|---|---|---|---|
| GB | 2403238 | A | 12/2004 |
| WO | WO 9108374 | | 6/1991 |
| WO | WO9964714 | A | 12/1999 |
| WO | WO2005107395 | | 11/2005 |

OTHER PUBLICATIONS

U.S. Appl. No. 12/042,989, Expandable Centralizer for Expandable Pipe String, filed Mar. 5, 2008.

PCT/US2008/063097 International Search Report and Written Opinion, dated Sep. 9, 2008, 14 pages.

PCT/US2008/063163 International Search Invitation to Pay, dated Sep. 11, 2008, 6 pages.

PCT/US2008/068891 International Searh Report and Written Opinion, dated Sep. 29, 2008, 11 pages.

U.S. Appl. No. 11/828,943 "Apparatus for and Method of Deploying a Centralizer Installed on an Expandable Casing String", filed Jul. 26, 2007.

* cited by examiner

LOW CLEARANCE CENTRALIZER AND METHOD OF MAKING CENTRALIZER

BACKGROUND OF THE INVENTION

1. Field of the Invention

This invention is directed to casing centralizers having flexible bow springs for use in borehole completion operations, and particularly to centralizers that may be radially collapsed to pass through a small annular space, and that can deploy to generally center a casing within a borehole. More specifically, the present invention is directed to an integrally-formed centralizer in which the collars and the bow springs may be formed from a single tube.

2. Description of the Related Art

Centralizers are commonly secured at spaced intervals along a casing or tubing string to provide radial stand-off of the casing or tubing from the interior wall of a borehole in which the string is subsequently installed. The centralizers generally comprise generally aligned collars defining a bore there through for receiving the casing, and a plurality of angularly-spaced ribs that project radially outwardly from the casing string to provide the desired stand-off from the interior wall of the borehole. Centralizers ideally center the casing within the borehole to provide a generally uniform annulus between the casing string exterior and the interior wall of the borehole. This centering of the casing string within the borehole promotes uniform and continuous distribution of cement slurry around the casing string during the subsequent step of cementing the casing string within an interval of the borehole. Uniform cement slurry distribution results in a cement liner that reinforces the casing string, isolates the casing from corrosive formation fluids, and prevents unwanted fluid flow between penetrated geologic formations.

A bow-spring centralizer is a common type of centralizer that employs flexible bow-springs as the ribs. Bow-spring centralizers typically include a pair of axially-spaced and generally aligned collars that are coupled one to the other by a plurality of bow-springs. The flexible bow-springs are predisposed to deploy and bow radially outwardly away from the axis of the centralizer to engage the interior wall of the borehole and to center a casing received axially through the generally aligned bores of the collars. Configured in this manner, the bow-springs provide stand-off from the interior wall of the borehole, and may flex or collapse radially inwardly as the centralizer encounters borehole obstructions or interior wall of the borehole protrusions into the borehole as the casing string is installed into the borehole. Elasticity allows the bow-springs to spring back to substantially their original shape after collapsing to pass a borehole obstruction, and to thereby maintain the desired stand-off between the casing string and the interior wall of the borehole.

Some centralizers include collars that move along the length of the casing in response to flexure of the bow springs. For example, U.S. Pat. No. 6,679,325 discloses, in part, a low-clearance centralizer having an extendable collar at each end, each extendable collar comprising a moving collar and a stop collar that cooperate to form an extendable collar. The extendable collar at each end of the centralizer of the '325 Patent includes a longitudinal bore within the aligned extendable collars for receiving the casing to which the stop collars are secured to position the centralizer on the casing. Each moving collar has a collet with a radially outwardly flanged portion for being movably received within an interior circumferential groove or bore within the mating stop collar. A plurality of flexible bow springs are secured at each end to a moving collar, and the two moving collars are maintained in a variable spaced-apart relationship by the bow springs and the stop collars.

A shortcoming of the centralizer of the '325 Patent is that the stop collar and the moving collar require axially overlapping structures in order to slidably interface one with the other. This overlapping structure adds to the radial thickness of a centralizer of comparable strength, thereby increasing the minimum collapsed diameter of the casing centralizer and limiting the borehole restrictions through which the centralizer and a casing can pass.

The radial thickness added to the exterior of a casing string by an installed centralizer is but one factor to be considered in selecting a centralizer for a given application. The cost of manufacturing the centralizer is also an important consideration. Many movable collars require the manufacture of complicated mechanisms as compared with simple stationary collars. Even less complicated designs include moving collars that are assembled using multiple components, each of which must be separately manufactured and subsequently assembled into a moving collar. While the end result is useful, the costs of manufacturing multiple components, and the costs associated with assembling the components into a centralizer, make these devices relatively expensive. Thus, there is an ongoing need for centralizers having extendable collars that are radially thinner, but less expensive to manufacture and assemble.

SUMMARY OF THE PRESENT INVENTION

The present invention provides a low-clearance and efficiently manufactured centralizer for use in centering a casing within an earthen borehole. The low-clearance centralizer comprises a stop collar having a bore, the stop collar securable to the exterior of a casing in a spaced-apart relationship to an opposing stop collar having a generally aligned bore, the opposing stop collar also securable to the exterior of the casing. Each stop collar is movably interlocked with and cooperates with a moving collar that is formed along with the stop collar from a single tube. Each moving collar is secured to its stop collar using a circumferentially interlocking structure to form an extendable collar. The moving end of the extendable collar receives and secures to the ends of a plurality of bow-springs that may also be formed from the same single tube from which the extendable collar is formed.

The bow springs of the centralizer of the present invention are modified—after being cut from the tube—to bow radially outwardly and thereby deploy against a interior wall of the borehole to provide stand-off between the casing and the interior wall of the borehole. The bow springs are sufficiently flexible to elastically collapse from the deployed condition to a collapsed condition to lie generally along the length of the exterior wall of the casing received within the centralizer. A portion of the arc length of the bow springs in their deployed (or bowed) condition is receivable within the retracted length of one of the extendable collars. The centralizer of the present invention is adapted for being pulled through a tight restriction in the borehole by the leading extendable collar. The extendable collars may be designated as a leading collar and a trailing collar, depending on the direction of movement of the casing string and the centralizer affixed thereon. As the deployed bow springs encounter the borehole restriction, the leading extendable collar is extended to its greatest length upon being introduced into the borehole restriction; that is, the leading moving collar, and the bow springs secured at a leading end to the leading moving collar, slide—according to the collapsing force imparted to the bow springs by the borehole restriction—to an extreme configuration for separation of the leading stop collar from the leading moving collar to fully extend the leading extendable collar. As the bow springs continue to collapse to lie generally flat along the exterior surface of the portion of the casing between the leading and trailing extendable collars, a portion of the arc length from previously bowed and deployed bow springs is generally straightened and received within the stroke of the trailing extendable collar as it retracts to a shorter length. Upon passage of the bow springs of the centralizer through the borehole restriction, the resiliency of the bow springs restore the bow springs to their radially outwardly deployed condition and both the leading and the trailing extendable collars are restored to their extended condition, unless the centralizer continues to be shaped by some outside force such as frictional contact between the deployed bow springs and the interior wall of the borehole.

The low-clearance centralizer of the present invention achieves its low-clearance design as a result of the inventive method of making the centralizer from a tube. Preferably, a laser is used to cut a tube into three interlocking pieces comprising two stop collars at the ends, and a center assembly, comprising two moving collars with a plurality of bow springs, intermediate the two moving collars. Alternately, a high pressure water nozzle may be used to create a water jet to cut the tube wall. The centralizer formed in this manner from a single tube in accordance with the present invention comprises two extendable collars, each extendable collar comprising one of the stop collars movably interlocked with the adjacent moving collar of the center assembly. The movement between a stop collar and the adjacent moving collar is provided by cutting the tube into an interlocking pattern and by strategically cutting and removing coupons from the interlocked wall of the tube to facilitate axial movement, but not rotation, between the stop collar and the adjacent moving collar. The cutting and removal method of the present invention results in protrusions extending from one of either the moving collar or the stop collar, or both, being slidably captured within a chamber cut into the other.

DETAILED DESCRIPTION OF THE PRESENT INVENTION

Figure 1:
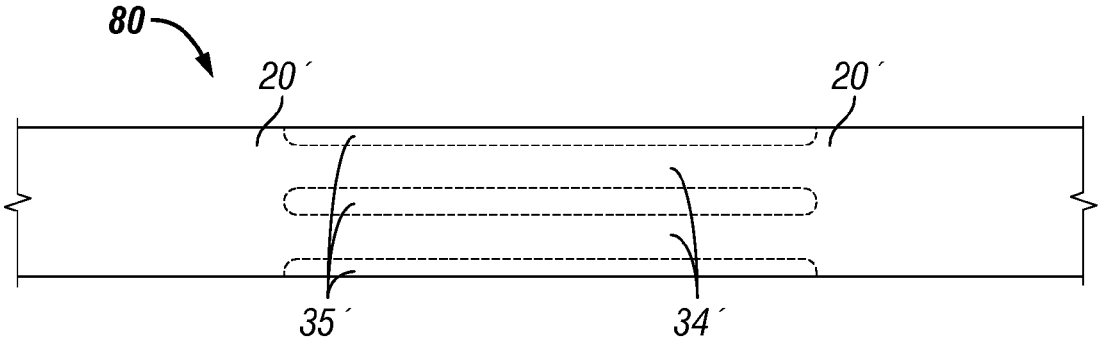
FIG. 1 is a side elevation view of tube having a superimposed pattern illustrating the cuts for making the central cage assembly of one embodiment of the centralizer of the present invention.

The present invention provides a centralizer and a method of forming a centralizer. The centralizer of the present invention comprises three members: a cage comprising a plurality of bow springs intermediate a first extendable collar and a second extendable collar. The centralizer of the present invention is cut from a tube using a laser or some other device for precision cutting the wall of a tube.

In one embodiment of the method of the present invention, the tube is cut, preferably using a laser, along a pre-programmed pattern to remove generally elongate material coupons to form an open-ended and generally tubular cage having a plurality of generally parallel ribs. The ribs are preferably equi-angularly distributed about the axis of the tube. At each end of the cage, and after the ribs of the cage are formed into bow springs, the remaining portions of the tube are cut to form a pair of opposed extendable collars, each comprising a stop collar and a moving collar. The stop collar and moving collar of each extendable collar are permanently interlocked one with the other unless one or both are deformed from their generally tubular shape to be separated.

The stop collar and the moving collar are formed, one adjacent to each end of the cage, by cutting the tube wall in a circumferentially interlocked configuration, and by strategic removal of material coupons from the wall of the tube. The stop collar and the moving collar formed thereby are generally rotatably locked, but axially movable, one relative to the other. The range of axial movement between the stop collar and the moving collar is determined by the axial length of the removed material coupons and the configuration of the portions of the pattern that extend along the axis of the tube.

The interlocked configuration cut into the tubular wall in forming each extendable collar may vary in geometrical shape. Generally, the interlocked configuration comprises two interlocked tubular members, a stop collar and a moving collar. Each interlocked tubular member of the extendable collar includes a plurality of circumferentially distributed heads, each head integrally formed on the end of an extension that extends axially from the member. Each head is captured within a circumferential chamber formed intermediate adjacent extensions from the opposite interlocked member. The axial extensions from the stop collar, which are shaped from the wall of the tube, are integrally formed with heads that are slidably captured within chambers that are cut into the wall of the tube from which the moving collar is formed. Also, the axial extensions from the moving collar, which are shaped from the wall of the tube, are integrally formed with heads that are slidably captured within chambers that are cut into the wall of the tube from which the stop collar is formed. The heads connected to the extensions may have a variety of shapes, such as generally rectangular, arrow-shaped or bulbous or teardrop-shaped, but all are generally curved with the radius of the wall of the tube from which the extendable collars/extension/heads are cut.

Each head is integrally formed with a generally central axially-oriented extension intermediate the head and the body of the tubular member (i.e., the stop collar or the moving collar). Each head is axially movably captured within one of a plurality of chambers formed within the tubular member. Consecutive, angularly distributed extensions of the first tubular member define the side walls of a chamber in which a head of the opposing second tubular member is movably captured (the "captured head"), and vice-versa. The body of the first tubular member may provide an end wall of a chamber within the first tubular member for limiting movement of the captured head extending from the second tubular member in the axial direction. Each extension from a tubular member is slidably received within the space between adjacent heads of the other tubular member. The heads integrally formed on consecutive extensions of the first tubular member limit axial movement of the captured head extending from the second tubular member. The first and second tubular members are, thereby, rotatably locked on relative to the other, and axially movable one relative to the other between a retracted configuration corresponding to the shorter configuration of the extendable collar and an extended configuration corresponding to the extended configuration of the extendable collar.

In the extended configuration, each captured head of one tubular member abuts the heads on the interlocked tubular member that, in part, define a portion of the chamber. In the retracted configuration, the captured heads may, but do not necessarily, abut the end walls of the respective chamber (see discussion of allowance for debris accumulation below). Thus, the first and second tubular members are "slidably interlocked" within a defined range of axial movement between the extended and retracted configurations.

FIG. 1 is a side elevation view of tube 80 having a superimposed pattern illustrating the cuts for making a cage that may be formed into the bow springs of a centralizer of the present invention. While an actual pattern could be literally drawn on the exterior wall of the tube, it is preferable that a cutting pattern be programmed into a memory storage device having a computer for automated positioning and movement of a cutting device, such as a laser or a water jet, along a predetermined set of positions to cut the wall of the tube 80. For example, cutting of the tube according to the superimposed pattern may be effected by either moving and positioning a laser beam of sufficient power to follow the pattern to cut a stationary tube 80, or by moving and positioning a tube 80 along a predetermined set of positions relative to a stationary laser beam, or by positioning both the laser and the tube simultaneously. The axially extending cage defined by the superimposed pattern on the tube 80 in FIG. 1 comprises elongate ribs 34' extending in an axial direction. As seen in FIG. 1, the cutting of the tube 80 along the pre-programmed pattern will result in the cutting of a plurality of material coupons 35' that may be removed from the tube wall to form the cage.

Figure 2:
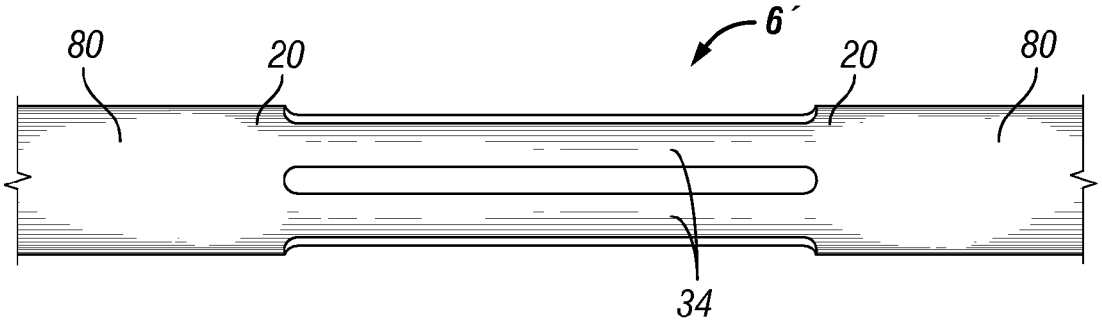
FIG. 2 is a side elevation view of a cage produced from the tube of FIG. 1 by cutting according to the superimposed pattern shown in FIG. 1 and to remove a plurality of elongate material coupons from the wall of the tube to form a cage intermediate two remaining uncut portions of the tube.

FIG. 2 is a side elevation view of an open-ended cage produced from the tube 80 of FIG. 1 by cutting according to the pre-programmed pattern and to remove a plurality of material coupons 35' from the wall of the tube 80 to form a cage comprising a plurality of ribs 34 intermediate two remaining portions of the tube 80. The cage may generally be formed by using a laser to cut three or more generally identical elongated and angularly distributed material coupons (see FIG. 1, elements 35') from the tube wall. The removal of the elongate coupons from the tube 80 leaves a plurality of three or more ribs 34 thereby forming a generally cylindrical cage from the tube 80.

Figure 3:
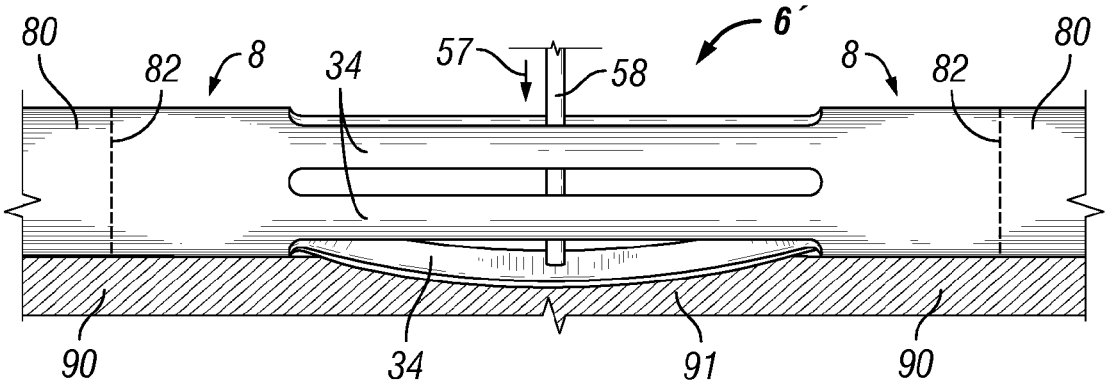
FIG. 3 is a side elevation view of the cage of FIG. 2 supported at each end by a support member, and a pushrod engaging and displacing a rib of the cage to form a bow spring.
Figure 4:
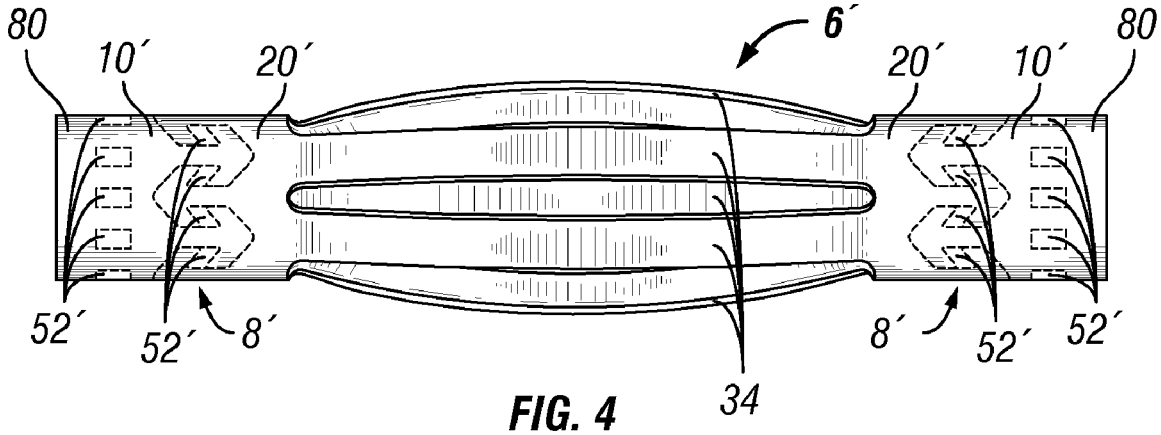
FIG. 4 is the elevation view of the cage with bow springs intermediate a pair of superimposed patterns illustrating cuts for making an extendable collar adjacent to each end of the bow springs.

FIG. 3 is an elevation view of the cage and tubular end portions 80 of FIG. 2 supported at each end portion by a support member 90 to support the cage while a pushrod 58 is used to displace a rib 34 from its original position shown in FIG. 2 to a radially outwardly bowed position shown for the bottom rib 34 in FIG. 3 (and later, for all of the ribs 34, as shown in FIG. 4). FIG. 3 shows a pushrod 58 engaging and displacing the bottom rib 34 of the cage in the direction of the arrow 57 to form a bow spring having a generally arcuate center portion. A die 91 may be disposed into position to receive and shape the bow spring 34 as the pushrod 58 is applied to shape the rib into a bow spring. The die 91 may be integral with or separate from the support members 90.

The cage of FIGS. 2-3 cut from the tube 80 of FIG. 1 has five equi-angularly distributed ribs 34 but could have any number of ribs and function well in this application. A centralizer blank 6' having an even number of equi-angularly distributed ribs will not have an elongate aperture directly (180 degrees) across the centralizer blank 6' from it for introduction of the pushrod 58, and these types of centralizer blanks 6' may require the use of two pushrods applied through separate elongate apertures and displaced against a rib 34 simultaneously. Alternately, the radially outward displacement of the ribs 34 may be accomplished using an inflatable hydraulic or pneumatic bladder positioned generally in the center of the cage and enlarged or inflated to expand and shape the ribs into bow springs 34 like those shown in FIG. 4. In still another alternative method, the bow springs 34 may be formed by positioning a substantially compressible cylinder of elastomeric material within the cage with the diameter of the cylinder of material approaching the inside diameter of the tubular portions 80, and then axially compressing the cylinder of material from each end to cause it to bulge outwardly to engage and radially outwardly displace the ribs. In still another alternative method, the ribs may be formed into bow springs by inserting a shaft having splines along a first portion that are reversed from splines along a second portion, the first portion receiving a first threaded collar and the second portion receiving a second threaded collar, the first and the second threaded collars coupled one to the other through a plurality of angularly distributed spreader links so that when the shaft is rotated within the spreader assembly, the first and the second collars are adducted one toward the other to deploy the spreader links radially outwardly and away from the threaded shaft to engage and displace the ribs and to form the ribs into bow springs. These are a few of the number of methods in which the straight ribs may be formed into bow springs 34, and all such methods are within the scope of the present invention.

FIG. 4 is a side elevation view of the cage of FIG. 3 after the pushrod 58 has been used to displace and form each rib 34 (see FIG. 2) into a bow spring (see element 50 in FIG. 3), and after excess end portions of the tube 80 are cut along line 82 (see FIG. 3) and removed from the centralizer blank 6'. The bow springs 34 are preferably metallurgically treated to impart favorable mechanical properties to the bow springs 34. Specifically, the ribs 34 (see FIG. 2) may be displaced to form a bow spring 34, heated to an elevated temperature for a period of time, and then subsequently quenched to a lower temperature in a water or oil bath to impart desirable metallurgical grain size that provides favorable resiliency. It is within the scope of this invention to use a variety of treatments known in the metallurgical arts for imparting favorable mechanical properties to the bow springs 34 of the centralizer of the present invention.

FIG. 4 also shows the remaining end portions 80 of the tube 80 adjacent each end of the bow springs 34 with patterns 8' superimposed to illustrate the cuts to be made to the end portions 80 to form an extendable collar adjacent each end of the bow springs 34. The two generally tubular members to be made by cutting in accordance with the superimposed patterns in FIG. 4 are two stop collars 10' and two moving collars 20'. As seen in FIG. 4, the cutting of the end portions of the tube 80 in accordance with the superimposed pattern enables the removal of a plurality of material coupons 52' from the tube wall to form extendable collars 8' (see element 8 in FIG. 5) adjacent to each end of the bow springs 34 and epoxy retaining apertures 30 (see FIG. 5) adjacent to each end of the centralizer blank 6'.

Figure 5:
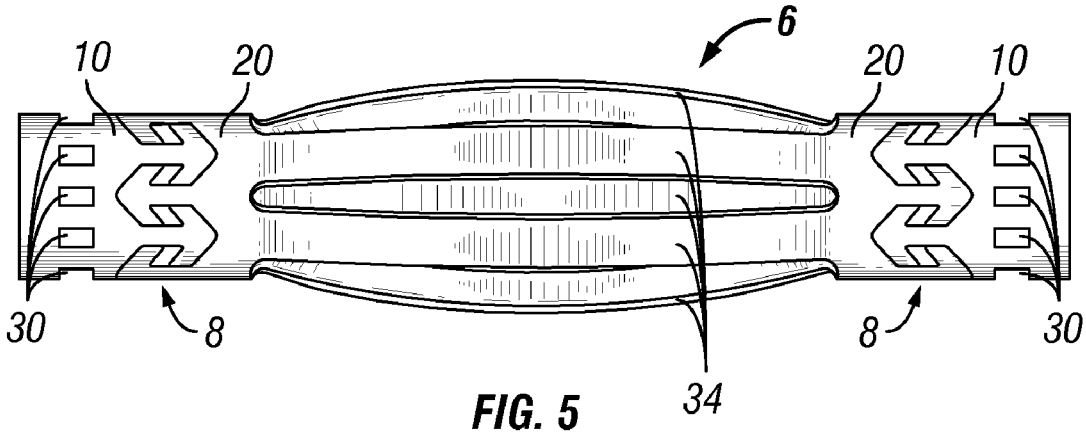
FIG. 5 is an elevation view of a centralizer formed from the cage and tube portions shown in FIG. 4 by cutting according to the superimposed patterns to form an extendable collar from each tube portion adjacent to each end of the cage with bow springs.

FIG. 5 is an elevation view of the centralizer blank 6' of FIG. 4 after the cutting tool is used to cut in accordance with the patterns 8' of FIG. 4 and the material coupons are removed to form the moving collars 20, the stop collars 10 and the epoxy retaining apertures 30.

Figure 6:
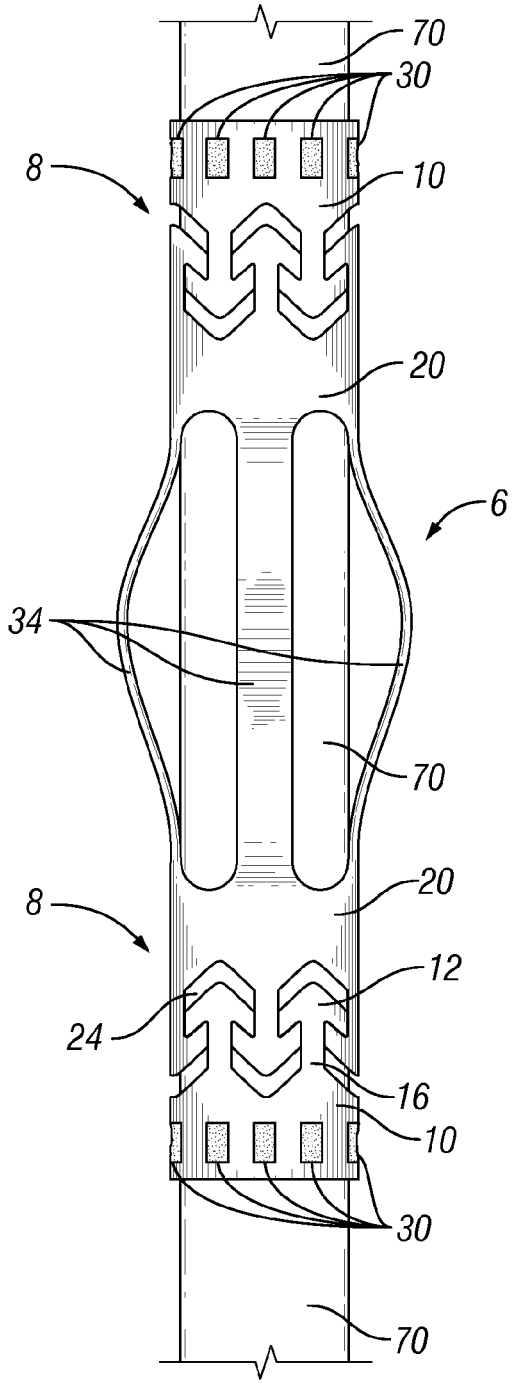
FIG. 6 is an elevation view of the centralizer of FIG. 5 received and secured on a casing for being installed in a borehole.

FIG. 6 is an elevation view of the centralizer 6 of FIG. 5 received on a casing 70 for being installed in a borehole. The centralizer 6 is securable to the casing 70 in a number of ways, including the use of set screws which tighten to grip the casing 70 within the stop collar 10. Preferably, the centralizer 6 is secured to the casing 70 by use of epoxy adhesive being applied to epoxy retaining apertures 30 where it is allowed to cure. This method of securing a centralizer to a casing is described in more detail in a patent application filed on Jun. 28, 2006 and assigned U.S. Ser. No. 11/427,251, and is incorporated by reference into this disclosure.

The bow springs 34 are shown in their radially outwardly deployed configuration to provide stand-off from an interior wall of the borehole during installation of the casing 70 into a borehole. Each of the upper and lower extendable collars 8 are shown in the extended configuration as the deployed bow springs 34 pull the moving collars 20 toward the center portion of the centralizer 6 and away from the stop collars 10 that are secured to the exterior of the casing 70.

Figure 7:
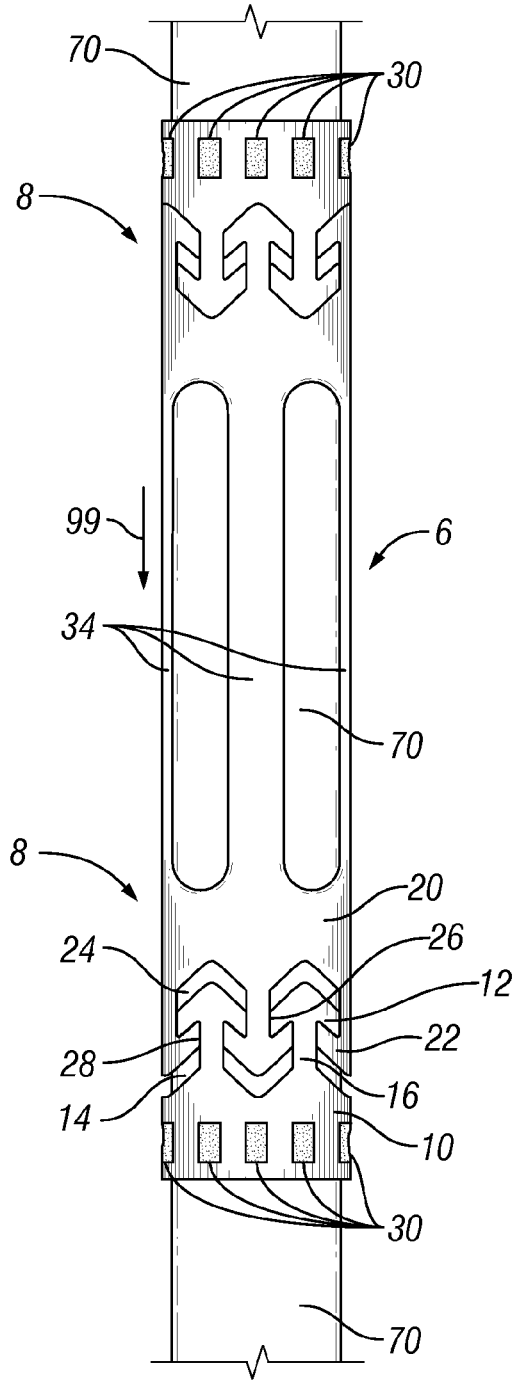
FIG. 7 is the centralizer and casing of FIG. 6 with the bow springs of the centralizer collapsed to lie along a portion of the exterior of the casing and the upper extendable collar retracted to receive a portion of the arc length surrendered by the bow springs upon collapse.

FIG. 7 is the centralizer 6 and casing 70 of FIG. 6 with the bow springs 34 of the centralizer 6 collapsed to lie in a generally linear condition along a portion of the exterior of the casing 70 and the upper extendable collar 8 receiving a portion of the arc length surrendered by the bow springs 34 upon collapse. This configuration is that which the centralizer 6 is likely to exhibit when the casing 70 is installed into a borehole and the centralizer 6 encounters a borehole restriction through which the centralizer 6 must pass. The configuration of the centralizer 6 shown in FIG. 7 results from the casing 70 being lowered in the direction of the arrow 99 into a borehole with the bottom or lower extendable collar 8 shown in FIG. 6 being the leading collar and the top or upper extendable collar 8 being the trailing collar. As the bow springs 34 encounter borehole restrictions or protrusions from the interior wall of the borehole that require the bow springs 34 to collapse inwardly toward the casing 70, the resistance of the bow springs 34 to collapse causes the leading extendable collar 8 to be extended. As the bow springs are further collapsed to their configuration shown in FIG. 7, at least a portion of,the arc length of the deployed bow springs 34 (see FIG. 6) is surrendered and absorbed by retraction of the trailing extendable collar 8, which is shown in the retracted configuration in FIG. 7. The trailing or upper extendable collar 8 in FIG. 7 is shown to be fully retracted, that is, there is no capacity of the trailing extendable collar to be further retracted. It is preferred that the extendable collar be structured with excessively sized chambers (see element 24 in FIG. 6) so that an accumulation of dirt or debris within the chamber during installation of the casing 70 in a borehole would not prevent movement of the head (see element 12 of FIG. 6) into the chamber 24 that would prevent the bow springs 34 of the centralizer 6 from fully collapsing to pass through a borehole restriction.

Figure 8:
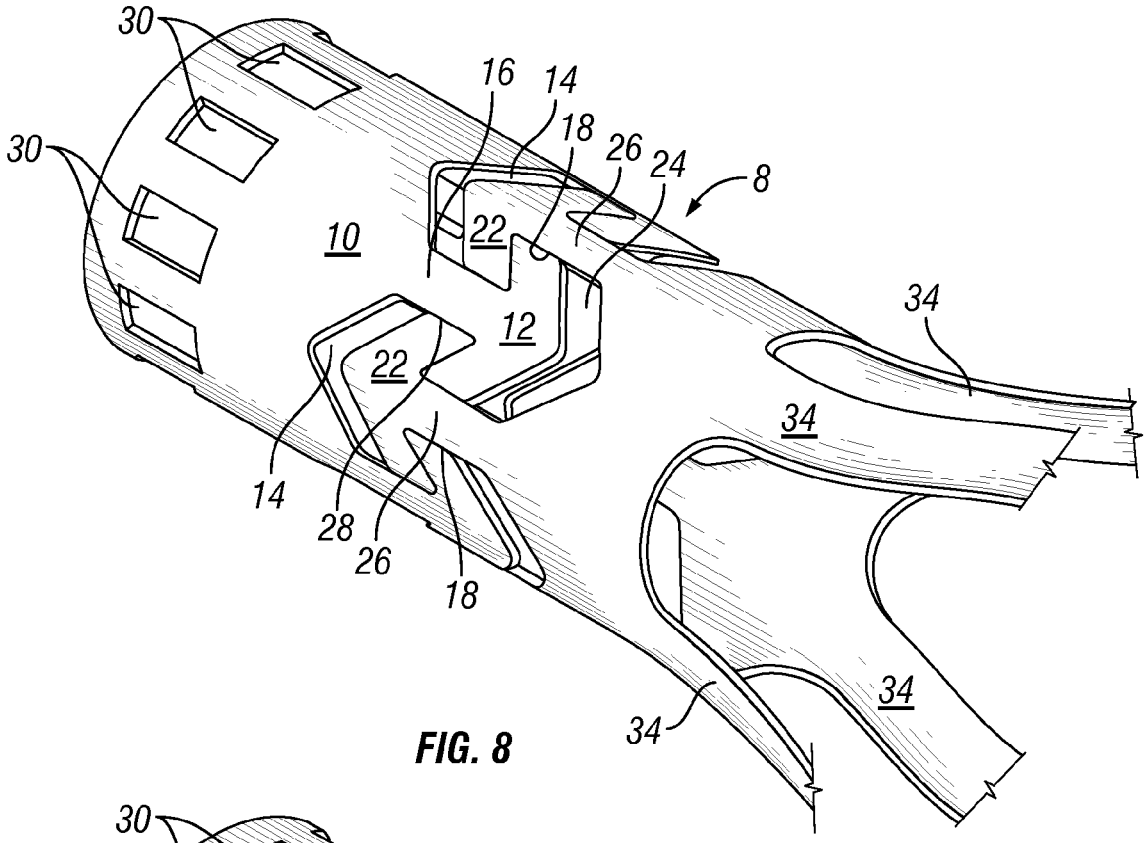
FIG. 8 is a perspective view of one of the extendable collars of the centralizer of FIG. 6 in the extended position.

FIG. 8 is an enlarged perspective view of one of the extendable collars 8 of the centralizer 6 of FIG. 6, or the lower or leading extendable collar 8 of the centralizer 6 of FIG. 7, all of which are shown in the extended position. FIG. 8 shows the interlocking interrelationship of the heads 12 and 22 of the stop collar 10 and the moving collar 20, respectively, of the heads 12 of the stop collar 10 and the extensions 26 of the moving collar 20, and of the heads 22 of the moving collar 20 and the extensions 16 of the stop collar 10. The extended position of the extendable collar 8 shown is FIG. 8 is the configuration of the extendable collars in a centralizer 6 of the present invention when the bow springs 34 are deployed to pull the moving collars 20 inwardly toward the center of the centralizer 6, as shown in FIG. 6. Alternately, the extended position of the extendable collar 8 shown is FIG. 8 is the configuration of the leading extendable collar in a centralizer 6 of the present invention when the centralizer 6 is being drawn through a borehole restriction or past a borehole protrusion that presents an obstacle for the bow springs to pass in their deployed condition. An extendable collar will generally be a leading collar if it is the bottom extendable collar of the centralizer 6 being lowered into a borehole on a casing or, if it is the trailing collar, if it is the top extendable collar of the centralizer 6 being pulled upwardly toward the surface through a borehole restriction or past a interior wall of the borehole protrusion that presents an obstacle for the bow springs to pass in their deployed condition.

Figure 9:
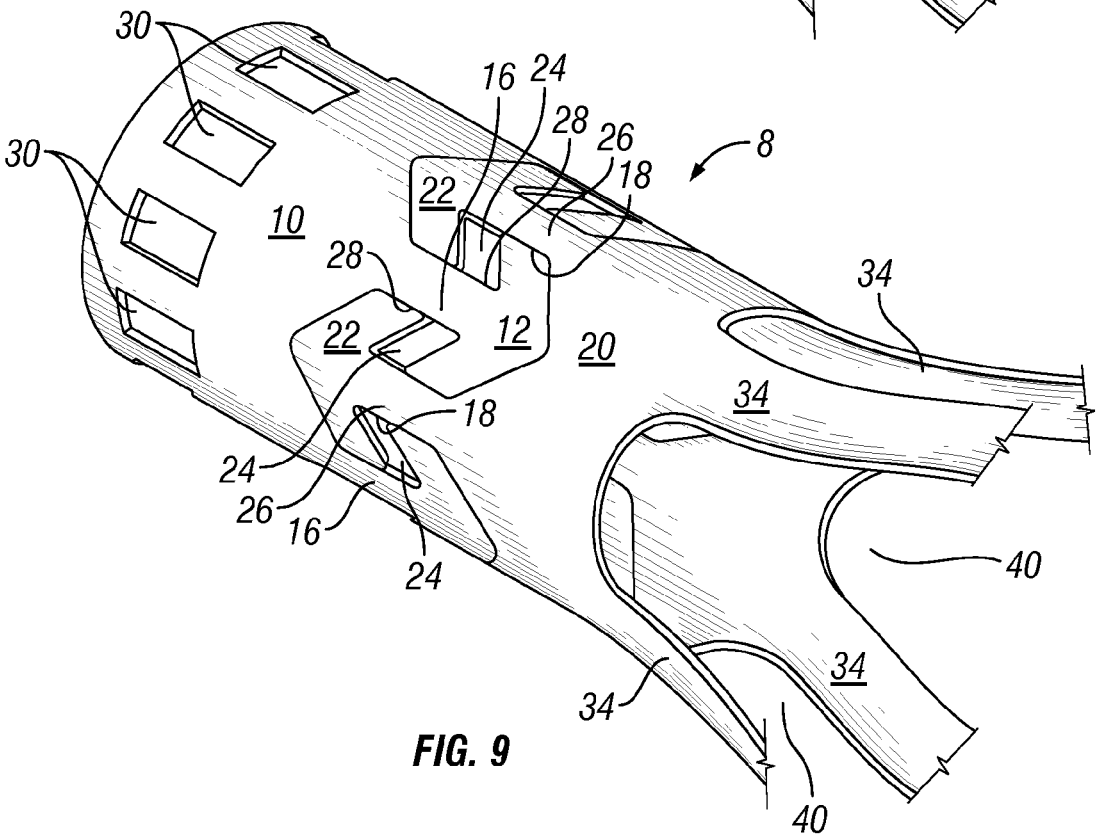
FIG. 9 is a perspective view of the lower extendable collar in FIG. 7 in the retracted position.
Figure 10:
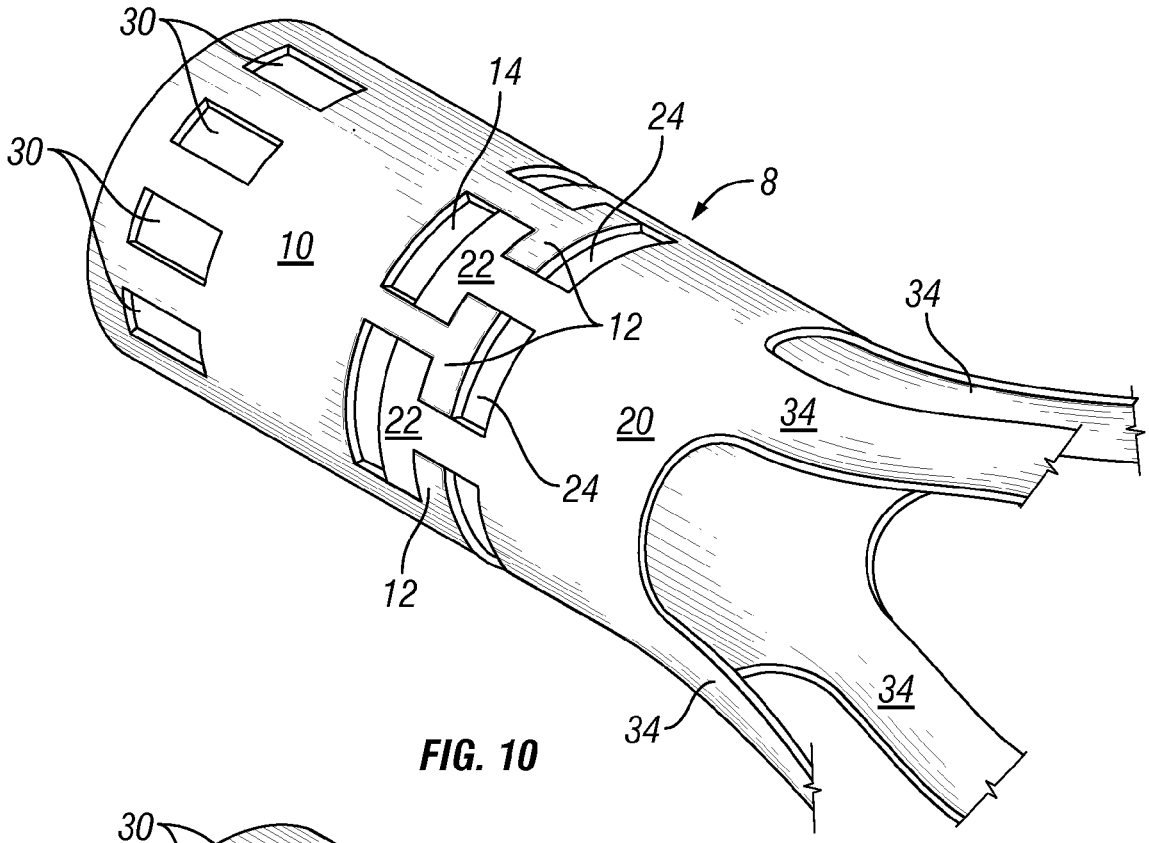
FIG. 10 is a perspective view of an alternate embodiment of an extendable collar of a centralizer of the present invention in the extended position.

FIG. 10 is a perspective view of an alternate embodiment of an extendable collar 8 portion of a centralizer 6 of the present invention in the extended position like the embodiment shown in FIG. 8. The alternate embodiment shown in FIG. 10 has a plurality of generally rectangular-shaped heads 12, 22 and chambers 14, 24 (when viewed as projected onto a plane) as compared to the generally arrow-shaped heads and chambers of the embodiment of FIGS. 6-9.

FIG. 9 is an enlarged perspective view of the upper or trailing extendable collar 8 of the centralizer 6 of FIG. 7 in the retracted position. It is clear that the removal of a generally larger coupon of material from the wall of the tube 80 used to make the centralizer 6 and to form the chamber (see element 14 in FIG. 8) will minimize the potential for an accumulation of debris clogging or otherwise preventing full retraction of the extendable collar 8. Similarly, the removal of a generally larger coupon of material from the wall of the tube 80 used to make the centralizer 6 and to form the chamber (see element 24 in FIG. 9) will minimize the potential for an accumulation of interior wall of the borehole debris clogging or otherwise preventing full extension of the extendable collar 8.

Figure 11A:
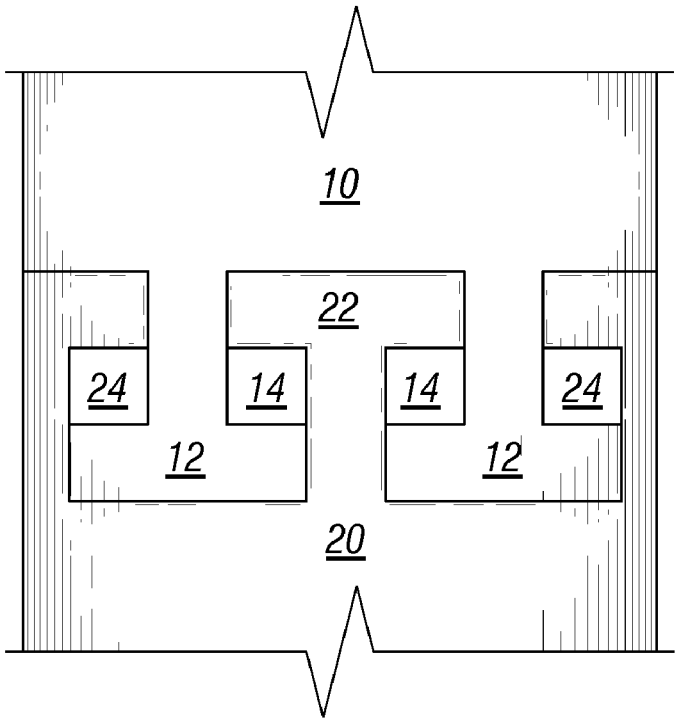
FIG. 11A is a flattened, plan view of the interlocked portion of the extendable collar of the centralizer of the present invention in the retracted position, taken along section lines A-A of FIG. 11.
Figure 11:
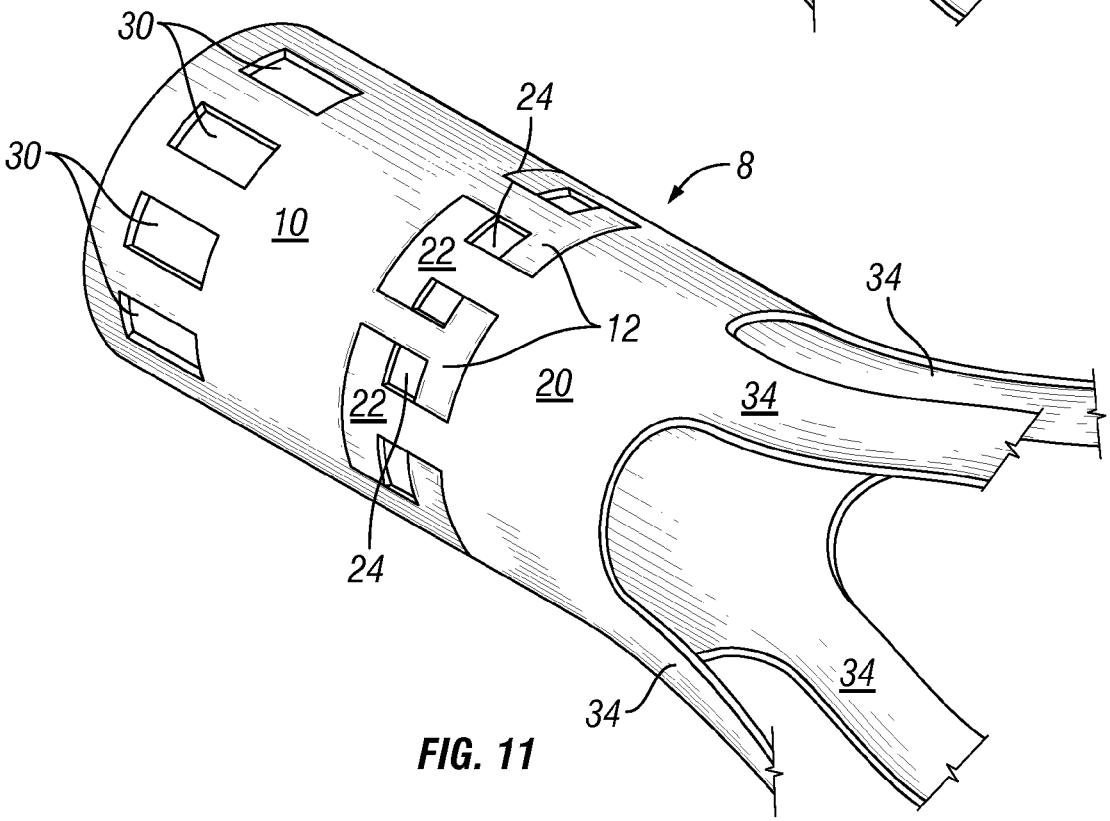
FIG. 11 is a perspective view of the axially extendable collar of FIG. 10 in the retracted position.

FIG. 11 is a perspective view of the alternate embodiment of the axially extendable collar of the centralizer 6 of the present invention of FIG. 10 in the retracted position like the embodiment shown in FIG. 9.

Figure 9A:
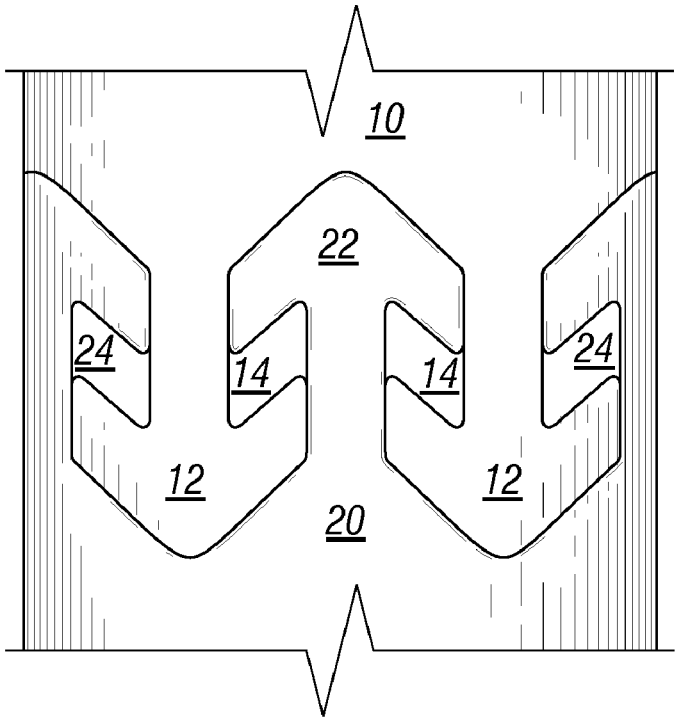
FIG. 9A is a flattened, plan view of the interlocked portion of the extendable collar of the centralizer of the present invention in the retracted position, taken along section lines A-A of FIG. 9.

FIG. 9A is a flattened, plan view of the interlocked portion of the extendable collar in the fully contracted position, taken along section lines A-A of FIG. 9.

FIG. 11A is a flattened, plan view of the interlocked portion of the extendable collar taken along section lines A-A of FIG. 11.

Figure 12:
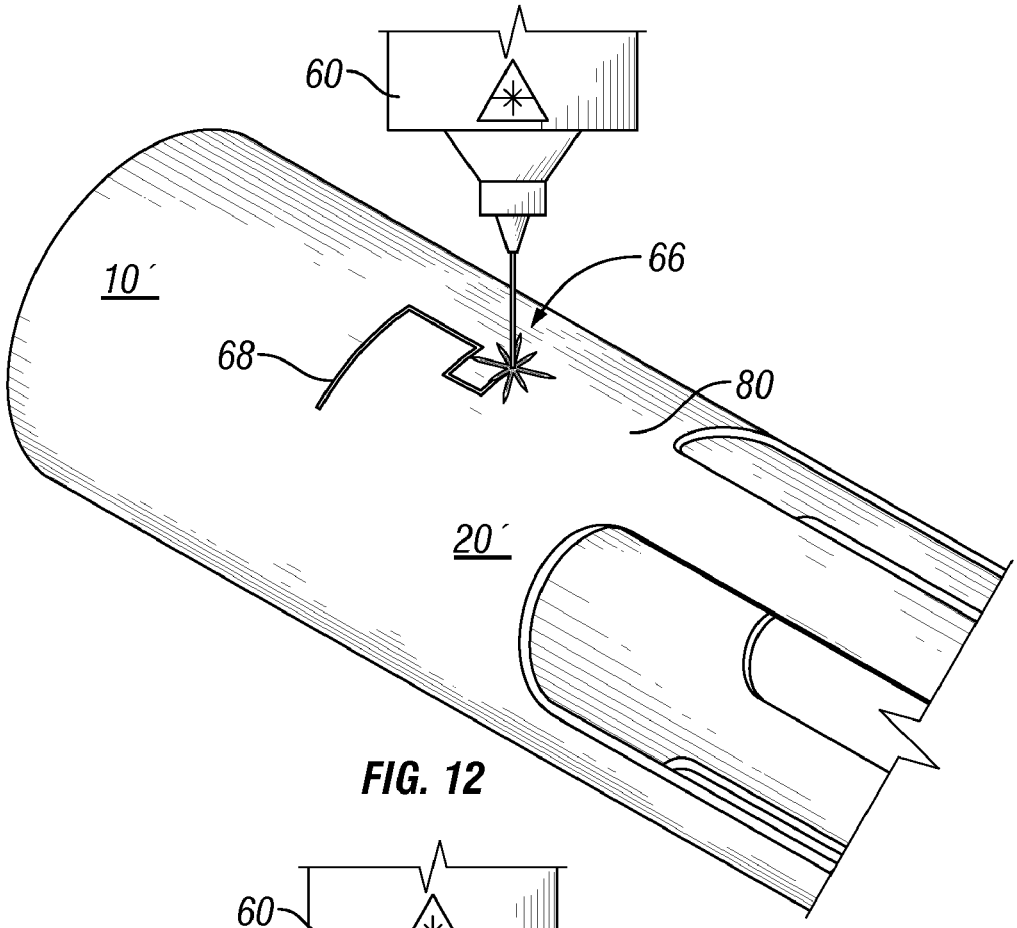
FIG. 12 is a perspective view of a tube being cut by a laser to form an extendable collar of one embodiment of the centralizer of the present invention.

FIG. 12 is a perspective view of a tube 80 being cut along a pattern 68 by a laser device 60 to form an embodiment of the extendable collar 8 of the centralizer 6 of the present invention. The laser beam 66 contains sufficient energy to cut through the wall of the tube 80 without significantly cutting or affecting the opposing diameter wall when the laser beam 66 penetrates the targeted wall. The first portion 10' of the segment of tube 80 being cut in FIG. 12 will form the stop collar 10 (see FIGS. 2-11) and the second portion 20' of the segment of tube 80 being cut in FIG. 12 will form the moving collar 20 of the centralizer 6. A variety of lasers capable of cutting metal tubulars are known in the art, and an in-depth discussion of lasers is therefore not warranted herein. As an overview, any suitable type of laser may be used to cut through the wall of a tube according to the present invention. The resulting cut is clean, square and generally distortion-free. Most laser cutting requires short setup times and requires little or no finishing.

Figure 13:
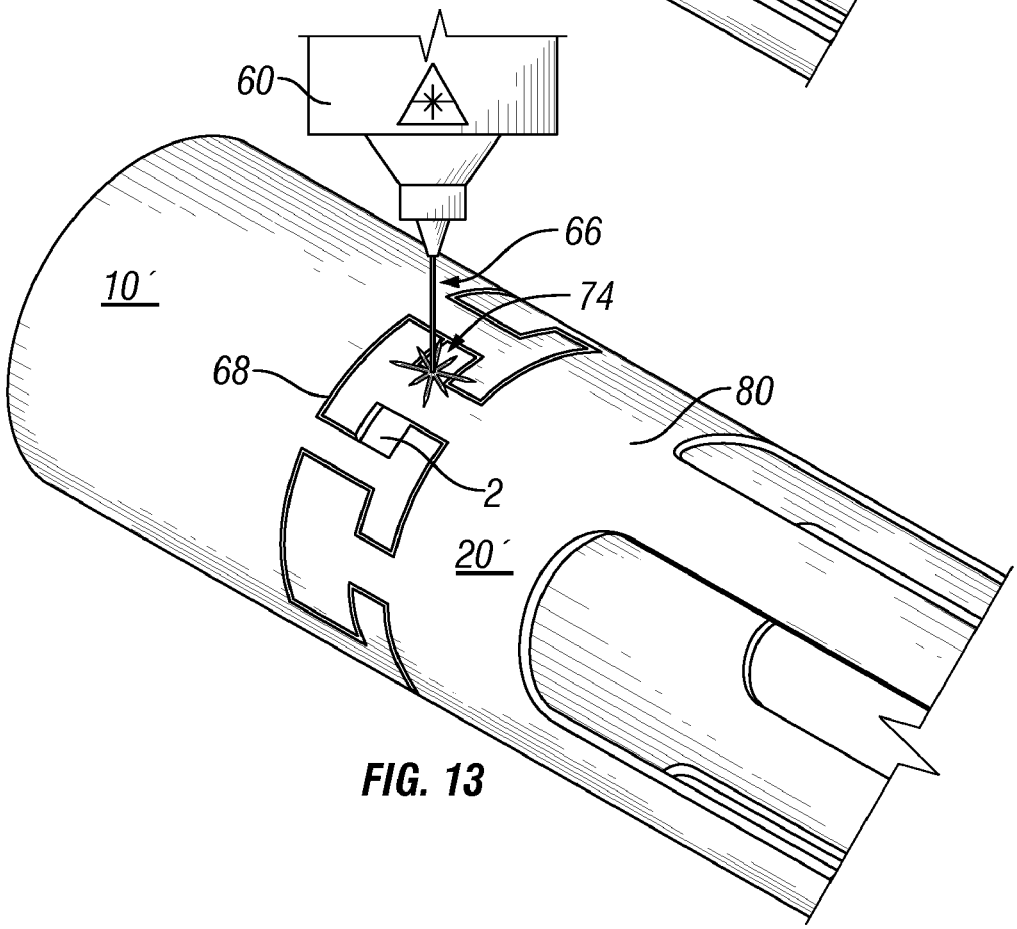
FIG. 13 is a perspective view illustrating the strategic removal of material coupons from the wall of the tube of FIG. 12 to form an extendable collar from the tube.
Figure 14:
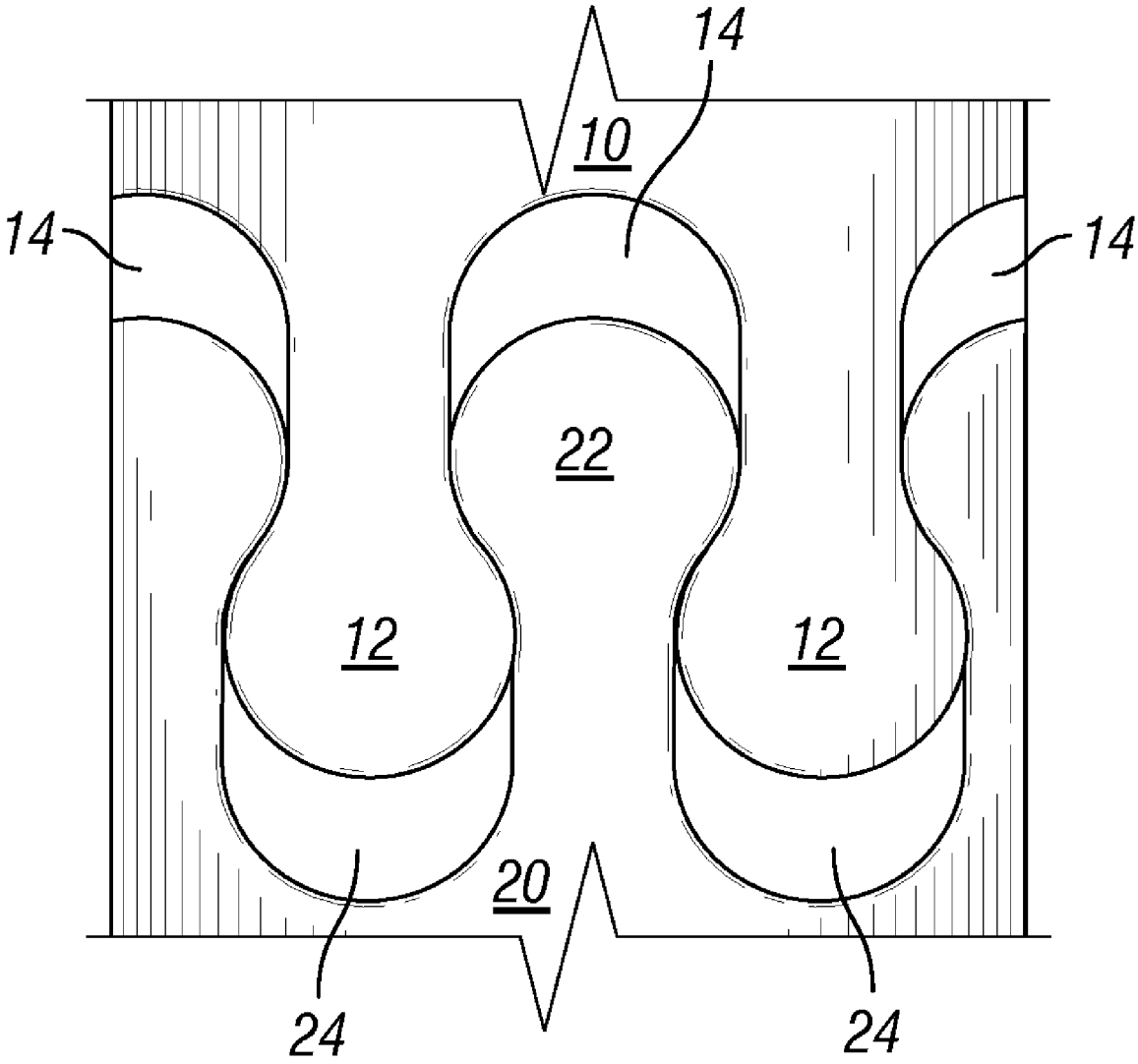
FIG. 14 is a flattened, plan view of the interlocked portion of an alternate embodiment of the extendable collar of the centralizer of the present invention wherein the heads have a bulbous shape.

FIG. 13 is a perspective view illustrating the strategic removal of a material coupon 74 from the wall of the tube 80 of FIG. 12 to form an extendable coupling 8 from the tube 80.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of making a bow spring centralizer having extendable collars, comprising:

cutting elongate portions from the center portion of a tube intermediate the first and second tubular ends to form a generally elongate cage with a plurality of generally angularly distributed ribs intermediate the first and second tubular ends;

forming a first extendable collar from the first tubular end by cutting the first tubular end into first and second interlocking tubular members and by removing portions of a wall of the first tubular end along the interlocking interface to form a first stop collar that is rotatably locked to, but slidably interlocked with, a first moving collar;

forming a second extendable collar from the second tubular end by cutting the second tubular end into first and second interlocking tubular members and by removing portions of a wall of the second tubular end to form a second stop collar that is rotatably locked to, but slidably interlocked with, a second moving collar that is opposite the elongate cage from the first moving collar, with both moving collars intermediate the first and second stop collars; and displacing the angularly distributed ribs radially outwardly from the axis of the tube to form a plurality of bow springs;

wherein the moving collars are integral with the plurality of bow springs, and wherein a bore of the first extendable collar and a bore of the second extendable collar are generally aligned for receiving a casing.

2. The method of claim 1, wherein the step of forming a first extendable collar further comprises cutting an interlocking pattern in the wall of the tube and cutting and removing coupons of material from the wall of the tube to form a plurality of heads secured to a first generally tubular portion of the first extendable collar that are slidably captured within chambers cut into the second generally tubular portion of the first extendable collar.

3. The method of claim 2 wherein the first generally tubular portion of the first extendable collar is the first moving collar, and the second generally tubular portion of the first extendable collar is the first stop collar.

4. The method of claim 2 wherein the first generally tubular portion of the first extendable collar is the first stop collar, and the second generally tubular portion of the first extendable collar is the first moving collar.

5. The method of claim 2 wherein the head is of a generally rectangular wherein the heads form a portion of the boundaries of the chambers.

6. The method of claim 2 wherein the heads, when projected onto a plane, are of a shape selected from generally rectangular, generally arrow-shaped and generally bulbous.

7. The method of claim 1, further comprising forming a plurality of apertures in the first stop collar and the second stop collar to form a plurality of apertures for receiving and retaining epoxy for securing the stop collar to the exterior of the casing.

8. The method of claim 7, wherein each head of the first tubular member is integral with an axial extension from the first tubular member, and each head on the second tubular member is integral with an axial extension from the second tubular member.

9. The method of claim 8, wherein with each extension is slidably received within a corresponding channel, wherein the circumferential width of each extension and the circumferential width of each channel are less than the circumferential width of the head in order to slidably capture the head within the chamber.

10. The method of claim 1, wherein the cutting is performed with a laser.

11. The method of claim 1, wherein the cutting is performed with a water jet.

* * * * *